US010024034B2

(12) United States Patent
Nicoson et al.

(10) Patent No.: US 10,024,034 B2
(45) Date of Patent: Jul. 17, 2018

(54) METHODS AND SYSTEMS FOR DETECTING HEAVY MACHINE WEAR

(71) Applicant: Harnischfeger Technologies, Inc., Wilmington, DE (US)

(72) Inventors: Richard Nicoson, Hartford, WI (US); James R. Popp, Oak Creek, WI (US); Daniel Schlegel, Germantown, WI (US); Keith Pomerenke, Richfield, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 56 days.

(21) Appl. No.: 15/349,494

(22) Filed: Nov. 11, 2016

(65) Prior Publication Data

US 2017/0138019 A1 May 18, 2017

Related U.S. Application Data

(60) Provisional application No. 62/254,491, filed on Nov. 12, 2015.

(51) Int. Cl.
*E02F 9/28* (2006.01)
*E02F 3/30* (2006.01)
(Continued)

(52) U.S. Cl.
CPC ..... *E02F 9/2808* (2013.01); *E02F 9/267* (2013.01); *E02F 9/268* (2013.01); *E02F 9/285* (2013.01); *G08B 21/18* (2013.01); *E02F 3/301* (2013.01)

(58) Field of Classification Search
CPC . B23P 6/10; B02C 18/00; E01H 5/066; E02F 9/2808; E02F 9/268; E02F 9/2866;
(Continued)

(56) References Cited

U.S. PATENT DOCUMENTS 5,144,762 A 9/1992 Robinson
5,627,749 A 5/1997 Waterman et al.
(Continued)

FOREIGN PATENT DOCUMENTS

AU 2010100656 7/2010
CN 101832296 9/2010
(Continued)

OTHER PUBLICATIONS

Notice of Correction from the Chilean Patent Office for Application No. 2014000485 first known to us Oct. 25, 2017 (2 pages including Statement of Relevance).
(Continued)

*Primary Examiner* — Robert E Pezzuto
(74) *Attorney, Agent, or Firm* — Michael Best & Friedrich LLP

(57) ABSTRACT

Methods and systems for detecting heavy machine wear. One system includes a heavy machine tooth of an industrial machine having a working end and a mounting end opposite the working end. The system also includes a wear indicator included in the tooth. The wear indicator includes a conductive tip, a conductive outer body extending along at least a length of the tooth, a conductive inner core positioned within the outer body, and insulating material positioned between the outer body and the inner core. The conductive tip is positioned between the working end of the tooth and the outer body and electrically couples the outer body and the inner core to form an electric circuit. The system also includes a transmitter included in the tooth. The transmitter transmits a state of the electric circuit.

20 Claims, 15 Drawing Sheets

(51) Int. Cl.
*G08B 21/18* (2006.01)
*E02F 9/26* (2006.01)

(58) Field of Classification Search
CPC ... E02F 9/26; E02F 9/285; E02F 9/267; E02F 3/301; E02F 3/8157; E02F 3/8152; E02F 3/765; E02F 3/7604; E02F 3/7645; E21F 17/18; G03G 15/553; G03G 21/1657; G05B 19/4065; G08B 21/18
USPC .... 37/266, 444, 452–460; 340/10.1, 870.07; 701/50; 702/34
See application file for complete search history.

(56) References Cited

U.S. PATENT DOCUMENTS 5,709,043 A 1/1998 Jones et al.
5,743,031 A 4/1998 Launder et al.
5,743,033 A 4/1998 Gegel
5,937,550 A 8/1999 Emrich
6,030,143 A 2/2000 Kreitzberg
6,229,443 B1 5/2001 Roesner
6,374,990 B1 4/2002 Swinderman
6,415,916 B1 7/2002 Rini
6,469,638 B1 10/2002 Johnson
6,578,294 B2 6/2003 Ollinger, IV
6,729,052 B2 5/2004 Ollinger, IV et al.
6,735,890 B2 5/2004 Carpenter et al.
6,870,485 B2 3/2005 Lujan et al.
6,932,891 B2 8/2005 Wigg et al.
6,986,216 B2 1/2006 Emrich et al.
6,990,390 B2 1/2006 Groth et al.
6,993,861 B2 2/2006 Carpenter et al.
7,042,346 B2 5/2006 Paulsen
7,080,470 B2 7/2006 Jones
7,100,315 B2 9/2006 Carpenter et al.
7,139,494 B2 11/2006 Ono et al.
7,143,007 B2 11/2006 Long et al.
7,165,347 B2 1/2007 Ollinger, IV et al.
7,171,771 B2 2/2007 Briscoe
7,174,661 B2 2/2007 Briscoe
7,177,553 B2 2/2007 Ono
7,199,718 B2 4/2007 Kikuchi et al.
7,248,154 B2 7/2007 Menke
7,257,504 B2 8/2007 Bolander et al.
7,299,570 B2 11/2007 Emrich et al.
7,367,144 B2 5/2008 Jones et al.
7,406,399 B2 7/2008 Furem et al.
7,408,456 B2 8/2008 Whitesmith et al.
7,432,812 B2 10/2008 Ray
7,451,558 B2 11/2008 Jones
7,509,834 B2 3/2009 Bauchot et al.
7,526,886 B2 5/2009 McClanahan et al.
7,536,811 B2 5/2009 McClanahan
7,579,952 B2 8/2009 Osterholt et al.
7,652,579 B2 1/2010 Keyaki et al.
7,730,651 B2 6/2010 Carpenter
7,730,652 B2 6/2010 McClanahan et al.
7,739,814 B2 6/2010 Carpenter et al.
7,774,959 B2 8/2010 Kubo et al.
7,827,846 B2 11/2010 Bauchot et al.
7,832,129 B2 11/2010 Briscoe
7,855,663 B2 12/2010 Briscoe
7,874,086 B2 1/2011 Briscoe et al.
7,882,649 B2 2/2011 Carpenter et al.
7,898,403 B2 3/2011 Ritter et al.
7,918,514 B2 4/2011 Dal Pra'
7,950,578 B2 5/2011 Majer
7,997,017 B2 8/2011 McClanahan et al.
8,004,397 B2 8/2011 McClanahan et al.
8,024,874 B2 9/2011 McClanahan et al.
8,061,064 B2 11/2011 Ollinger, IV et al.
8,074,383 B2 12/2011 McClanahan
8,104,200 B2 1/2012 Briscoe
8,122,621 B2 2/2012 Carpenter et al.
8,250,785 B2 8/2012 Kubo et al.
RE43,629 E 9/2012 Wu
8,308,094 B2 11/2012 Hoice et al.
8,312,650 B2 11/2012 McClanahan et al.
8,356,432 B2 1/2013 Carpenter
8,392,764 B2 3/2013 de Buen
8,411,930 B2 4/2013 Ridley et al.
8,572,870 B2 11/2013 Kudo et al.
8,578,637 B2 11/2013 Ollinger, IV et al.
8,763,282 B2 7/2014 Brufau Guinovart et al.
8,806,785 B2 8/2014 Brufau Guinovart et al.
8,872,643 B2 10/2014 Ebert
8,890,672 B2 11/2014 Miller
9,041,533 B1 5/2015 Villa et al.
9,243,381 B2 1/2016 Behmlander et al.
9,311,513 B2 4/2016 Miller
2002/0005297 A1 1/2002 Alft et al.
2004/0227645 A1 11/2004 Lujan et al.
2004/0266296 A1 12/2004 Martinsson et al.
2005/0007239 A1 1/2005 Woodard et al.
2005/0288937 A1 12/2005 Verdiramo
2006/0025957 A1 2/2006 Lind et al.
2006/0042734 A1 3/2006 Turner et al.
2006/0226984 A1 10/2006 Menke
2006/0261146 A1 11/2006 Harada et al.
2007/0108296 A1 5/2007 Konopka et al.
2007/0163325 A1 7/2007 Radzisewski et al.
2007/0241908 A1 10/2007 Coop
2007/0290856 A1 12/2007 Martin
2008/0000114 A1 1/2008 Bentley
2008/0001771 A1 1/2008 Faoro et al.
2008/0231458 A1 9/2008 Fein
2008/0284571 A1 11/2008 Wilbrink et al.
2009/0289582 A1 11/2009 Armitage et al.
2010/0045311 A1 2/2010 Chung
2010/0079288 A1 4/2010 Collins et al.
2010/0142759 A1 6/2010 Ridley et al.
2010/0164742 A1 7/2010 Anderson
2010/0170119 A1 7/2010 Lopez Almendros et al.
2010/0238002 A1 9/2010 Ryan et al.
2010/0275473 A1 11/2010 Maher
2011/0162241 A1 7/2011 Wangsness
2011/0200193 A1 8/2011 Blitz et al.
2011/0260834 A1 10/2011 Chapman et al.
2012/0098654 A1 4/2012 Ebert
2012/0123611 A1 5/2012 Grasso et al.
2012/0260539 A1 10/2012 Guimaraes et al.
2013/0035875 A1 2/2013 Hall et al.
2013/0049935 A1 2/2013 Miller
2013/0174453 A1 7/2013 Cheyne et al.
2013/0207783 A1 8/2013 Cruzado et al.
2013/0271274 A1 10/2013 Ebert
2014/0039285 A1 2/2014 Goodnow et al.
2014/0173948 A1 6/2014 Ok et al.
2015/0035673 A1 2/2015 Miller
2015/0107075 A1 4/2015 Clarke et al.
2015/0149049 A1 5/2015 Bewley et al.
2015/0284935 A1 10/2015 Egger et al.
2016/0340866 A1 11/2016 Koetz et al.

FOREIGN PATENT DOCUMENTS

GB 1341814 12/1973
JP 2008291519 12/2008
SU 876887 10/1981
WO WO 20070128068 11/2007
WO WO 2010096873 9/2010
WO WO 20120017192 2/2012
WO WO 20120107848 8/2012
WO WO 20120116408 9/2012
WO WO 20150126923 8/2015

OTHER PUBLICATIONS

Examiner's Report from the Chilean Patent Office for Application No. 201601194 dated Oct. 16, 2017 (7 pages Including Statement of Relevance).

(56) References Cited

OTHER PUBLICATIONS

International Search Report and Written Opinion for Application No. PCT/US2012/052798 dated Nov. 16, 2012 (5 pages).

International Preliminary Report on Patentability for Application No. PCT/US2012/052798 dated Mar. 4, 2014 (5 pages).

First Examination Report from the Australian Patent Office for Application No. 2012302078 dated Nov. 21, 2014 (3 pages).

Second Examination Report from the Australian Patent Office for Application No. 2012302078 dated Mar. 20, 2015 (4 pages).

Examination Report from the Intellectual Property Office of Mexico for Application No. MX/a/2014/002453 dated May 3, 2015 (4 pages).

First Office Action from the State Intellectual Property Office of the People's Republic of China for Application No. 2012800426944 dated Jun. 1, 2015 (20 pages).

Office Action from the US Patent and Trademark Office for U.S. Appl. No. 14/517,479 dated Aug. 20, 2015.

Second Office Action from the State Intellectual Property Office of the People's Republic of China for Application No. 2012800426944 dated Jan. 28, 2016 (20 pages).

Office Action from the Federal Service for Intellectual Property of Russia for Application No. 2014112222 dated Apr. 6, 2016 (8 pages).

Office Action from the US Patent and Trademark Office for U.S. Appl. No. 15/066,499 dated May 18, 2016.

Third Office Action from the State Intellectual Property Office of the People's Republic of China for Application No. 2012800426944 dated Aug. 2, 2016 (19 pages).

Office Action from the US Patent and Trademark Office for U.S. Appl. No. 15/066,499 dated Sep. 28, 2016 (21 pages).

First Office Action from the State Intellectual Property Office of the People's Republic of China for Application No. 2016204742236 dated Sep. 18, 2016 (3 pages).

First Examination Report from the Australian Patent Office for Application No. 2015230856 dated Jun. 15, 2017 (6 pages).

PCT/US2016/061590 International Search Report and Written Opinion of the International Searching Authority dated Feb. 15, 2017 (9 pages).

Office Action from the US Patent and Trademark Office for U.S. Appl. No. 14/719,624 dated Nov. 21, 2016 (9 pages).

Decision to Grant with Search Report from the Russian Patent Office for Application No. 2016150829 dated Dec. 19, 2017 (22 pages with English Translation).

Examination Report from the Chilean Patent Office for Application No. 201601194 dated Feb. 14, 2018 (7 pages Including Statement of Relevance).

METHODS AND SYSTEMS FOR DETECTING HEAVY MACHINE WEAR

RELATED APPLICATIONS

This application claims priority to U.S. Provisional Application No. 62/254,491 filed Nov. 12, 2015, the entire content of which is herein incorporated by reference.

FIELD

Embodiments of the invention relate to detecting wear of heavy machine components, such as heavy machine teeth.

BACKGROUND

Heavy machines (for example, mining equipment, such as draglines and shovels) often include components that wear over time. For example, shovels and excavators include buckets with steel teeth. The teeth provide a smaller point of surface area when digging into the earth than the bucket. The smaller point of surface area helps to break up the earth and requires less force than the larger surface area of the bucket. In addition, as the teeth wear, the teeth can be replaced without requiring replacement of the bucket.

SUMMARY

Traditional methods for monitoring tooth wear are subjective and inconsistent. For example, experienced mining personnel may visually inspect a tooth for wear and estimate whether or when a tooth should be replaced based on a perceived wear level and past experience. However, due to this subjective monitoring, teeth may be replaced too early, which is costly and wasteful. Conversely, teeth may be allowed to wear past an optimized wear level, which can cause a drop in productivity or machine damage or failures. Additionally, when teeth wear down they may fall off of the machine. These broken teeth, however, must be detected and removed to prevent loss, damage, and damage to other machines (for example, crushers).

Accordingly, embodiments of the invention provide methods and systems for detecting machine wear, such as tooth wear. For example, one embodiment provides a system of detecting tooth wear. The system includes a heavy machine tooth formed from a rigid material (for example, steel) and including a working end and a mounting end opposite the working end. The mounting end is coupled to a heavy machine (for example, a bucket). The heavy machine tooth also includes a wear indicator (for example, embedded within the tooth) extending between the mounting end of the tooth and the working end of the tooth. As the rigid material of the tooth wears, a section of the wear indicator is exposed.

In some embodiments, the exposed section of the wear indicator functions as a visual indicator of tooth wear. For example, the exposed section of the wear indicator may have a distinguishing property as compared to the rigid material of heavy machine tooth, such as a different color than the color of the rigid material forming the heavy machine tooth. Accordingly, the distinguishing property may be visually detected (for example, by an operator or a visual detection system, such as a camera) to determine a wear level of the heavy machine tooth. In some embodiments, the wear indicator includes a plurality of sections where each of the plurality of sections has a different distinguishing property as compared to the rigid material of the heavy machine tooth. For example, each of the plurality of sections may have a unique color distinct from a color of the rigid material of the heavy machine tooth. Therefore, each of the plurality of sections may be associated with one of a plurality of wear levels of the heavy machine tooth. In some embodiments, the heavy machine tooth also includes a plurality of wear indicators, wherein each wear indicator has a different length and, optionally, a different distinguishing property as compared to the rigid material of the heavy machine tooth. Accordingly, a first wear indicator included in the plurality of wear indicator may be exposed before a second wear indicator included in the plurality of wear indicator as the rigid material of the heavy machine tooth wears. Thus, the first wear indicator indicates a first wear level of the heavy machine tooth and the second wear indicator indicates a second wear level of the heavy machine tooth.

Alternatively or in addition, the exposed section of the wear indicator functions as an electrical indicator of tooth wear. For example, the exposed section of the wear indicator may be formed of a conductive material (for example, brass, aluminum, steel, and the like) forming an electric circuit. When the conductive material is exposed, the conductive material also wears and opens the electric circuit. Accordingly, the state of the electric circuit may be detected to determine a wear level of the tooth. In some embodiments, the wear indicator includes a plurality of sections where each of the plurality of sections is formed of a different conductive material. Each of the plurality of sections may be associated with one of a plurality of wear levels of the heavy machine tooth. In some embodiments, the tooth also includes a plurality of wear indicators, wherein each wear indicator has a different length and, optionally, a different conductive material.

The wear indicator may also function as both a visual indicator and an electrical indicator within a single heavy machine tooth. For example, the conductive material may have a distinguishing property as compared to the rigid material of the heavy machine tooth (for example, color). Therefore, as the conductive material is exposed it provides both a visual indication and an electrical indication of tooth wear. Similarly, insulating material used with the conductive material to form the electric circuit may have a distinguishing property as compared to the rigid material of the tooth (for example, color). Therefore, as the tooth wears, the insulating material is exposed to provide a visual indicator of tooth wear. In addition, in some embodiments, a heavy machine tooth includes a plurality of wear indicators, wherein the plurality of wear indicators includes a first wear indicator functioning as a visual indicator and a second wear indicator functioning as an electrical indicator.

The system may also include a transmitter coupled to the wear indicator, wherein the transmitter wireless transmits data to a reader associated with tooth wear detected by the wear indicator. In some embodiments, the transmitter includes a passive radio-frequency identification (RFID) transponder and the reader includes a passive RFID reader (antenna).

For example, one embodiment of the invention provides a system for detecting heavy machine wear. The system includes a heavy machine tooth of an industrial machine having a working end and a mounting end opposite the working end. The working end interacts with a working material and the mounting end removably couples the heavy machine tooth to the industrial machine. The system also includes a wear indicator included in the heavy machine tooth. The wear indicator includes a conductive tip, a conductive outer body extending along at least a length of the heavy machine tooth defined between the working end and the mounting end, a conductive inner core positioned within the conductive outer body, and insulating material positioned between the conductive outer body and the conductive inner core. The conductive tip is positioned between the working end of the heavy machine tooth and the conductive outer body and electrically couples the conductive outer body and the conductive inner core to form an electric circuit. The system also includes a transmitter included in the heavy machine tooth. The transmitter transmits a state of the electric circuit.

Another embodiment of the invention provides a system including a heavy machine tooth of an industrial machine having a working end and a mounting end opposite the working end. The working end interacts with a working material and the mounting end removably couples the heavy machine tooth to the industrial machine. The system also includes a first wear indicator included in the heavy machine tooth. The first wear indicator includes a first conductive tip, a first conductive outer body, a first conductive inner core positioned within the first conductive outer body, and first insulating material positioned between the first conductive outer body and the first conductive inner core. The first conductive tip is positioned between the working end and the first conductive outer body at a first distance from the working end. The first conductive tip electrically couples the first conductive outer body and the first conductive inner core to form a first electric circuit. The system also includes a second wear indicator included in the heavy machine tooth. The second wear indicator includes a second conductive tip, a second conductive outer body, a second conductive inner core positioned within the second conductive outer body, and second insulating material positioned between the second conductive outer body and the second conductive inner core. The second conductive tip is positioned between the working end and the second conductive outer body at a second distance from the working end different than the first distance. The second conductive tip electrically couples the second conductive outer body and the second conductive inner core to form a second electric circuit. The system also includes at least one transmitter included in the heavy machine tooth. The at least one transmitter transmits at least one of a state of the first electric circuit and a state of the second electric circuit.

Another embodiment of the invention provides a system that includes a heavy machine tooth of an industrial machine having a working end and a mounting end opposite the working end. The working end interacts with a working material and the mounting end removably couples the heavy machine tooth to the industrial machine. The system also includes a wear indicator included in the heavy machine tooth. The wear indicator includes a first conductive body, a second conductive body, and a plurality of conductive walls electrically coupling the first conductive body and the second conductive body to form an electric circuit. The system also includes a sensor detecting a resistance of the electric circuit. The resistance of the electric circuit varies based on a number of the plurality of conductive walls destroyed as the heavy machine tooth wears. The system also includes a transmitter included in the heavy machine tooth. The transmitter transmits the detected resistance of the electric circuit.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways.

Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be utilized to implement the invention. It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (for example, stored on non-transitory computer-readable medium) executable by one or more electronic processors. As such, it should be noted that a plurality of hardware and software based devices, as well as a plurality of different structural components may be utilized to implement the invention. For example, "control units" and "controllers" described in the specification can include one or more electronic processors, one or more memory modules including non-transitory computer-readable medium, one or more input/output interfaces, and various connections (for example, a system bus) connecting the components.

Figure 1:
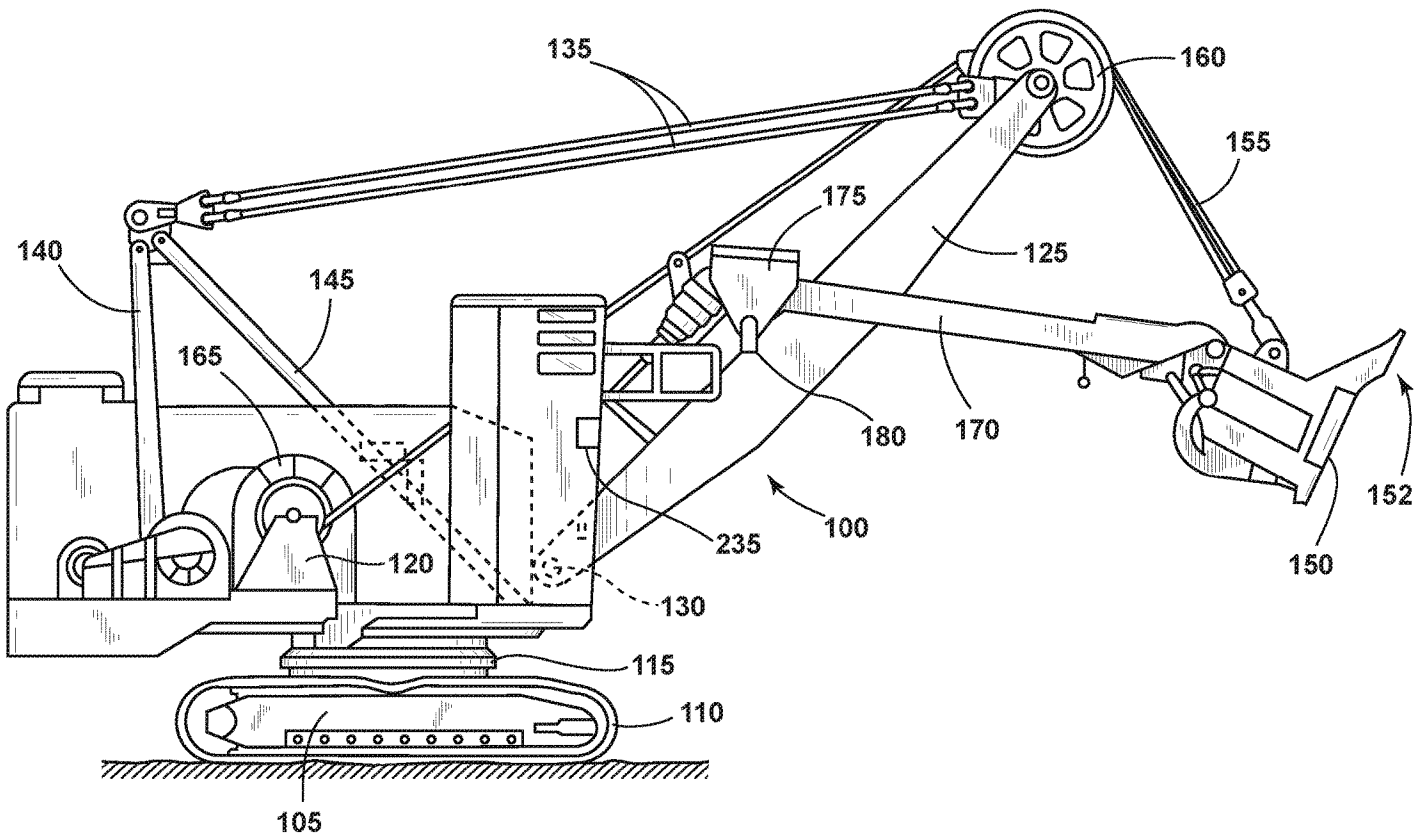
FIG. 1 is a side view of a shovel.

FIG. 1 illustrates a shovel 100. Although embodiments of the invention are described with respect to the shovel 100, it should be understood that embodiments of the invention may be used with other types of shovels and other types of machines and are not limited to use with the shovel 100.

The shovel 100 may be used for surface mining applications. The shovel 100 includes a mobile base 105 supported on drive tracks 110. The mobile base 105 supports a turntable 115 and a machinery deck 120. The turntable 115 permits rotation of the machinery deck 120 relative to the base 105 (for example, approximately 360 degree rotation).

A boom 125 is pivotally connected at joint 130 to the machinery deck 120. The boom 125 is held in an upwardly and outwardly extending relation to the deck 120 by a brace or gantry in the form of tension cables 135 which are anchored to a back stay 140 of a stay structure 145 rigidly mounted on the machinery deck 120.

The shovel 100 also includes a dipper or bucket 150 that includes a plurality of heavy machine teeth 152. The bucket 150 is suspended by a flexible hoist rope or cable 155 from a pulley 160. The cable 155 is anchored to a winch drum 165 mounted on the machinery deck 120. As the winch drum 165 rotates, the cable 155 is either paid out or pulled in, which lowers or raises the bucket 150. The pulley 160 directs the tension in the cable 155 to pull straight upward on the bucket 150 to produce efficient dig force. The bucket 150 is rigidly attached to an arm or handle 170. The handle 170 is slidably supported in a saddle block 175, which is pivotally mounted on the boom 125 at joint 180. The handle 170 has a rack tooth formation thereon (not shown) that engages a drive pinion or shipper shaft (not shown) mounted in the saddle block 175. The drive pinion is driven by an electric motor and transmission unit 185 to effect extension or retraction of the handle 170 relative to the saddle block 175.

One or more of the teeth 152 are removably attached to the bucket 150. Accordingly, broken or worn teeth 152 may be removed from the bucket 150 and replaced. The teeth 152, however, may also break or fall off the bucket 150. In some circumstances, a tooth 152 will break or fall off the bucket 150 and end up in the earth being mined (in example, in the bucket 150). When the earth in the bucket 150 is deposited in a truck, the tooth 152 goes into the truck as well. In some situations, the earth in the truck is taken to a crusher to be crushed. When the truck empties its contents into the crusher, the tooth 152 goes into the crusher as well, which can potentially damage the crusher, be expelled from the crusher and damage other equipment, be damaged in the crusher, or a combination thereof.

Figure 2B:
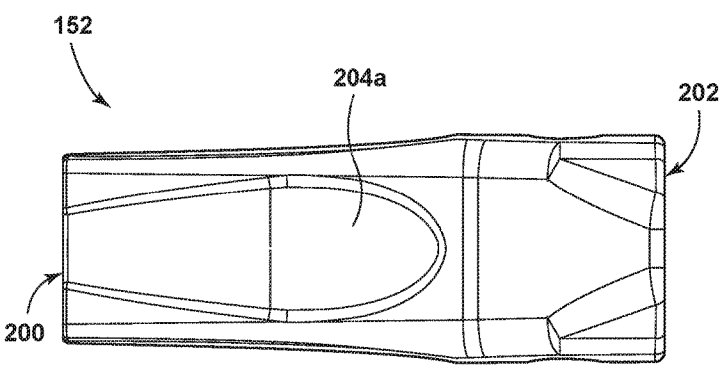
FIG. 2B is a top view of the tooth of FIG. 2A.
Figure 2A:
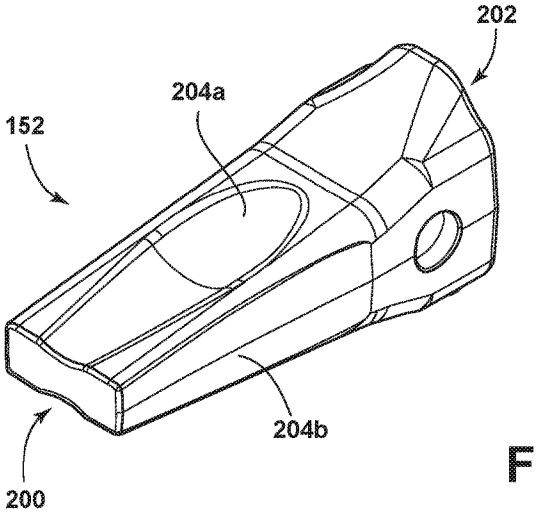
FIG. 2A is a perspective view of a tooth used with the shovel of FIG. 1.
Figure 2C:
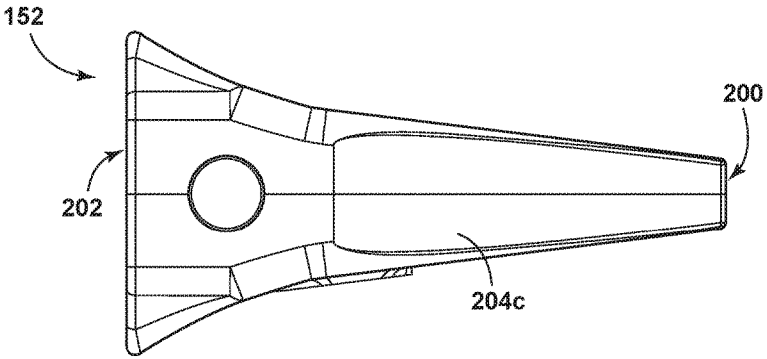
FIG. 2C is a side view of the tooth of FIG. 2A.
Figure 4B:
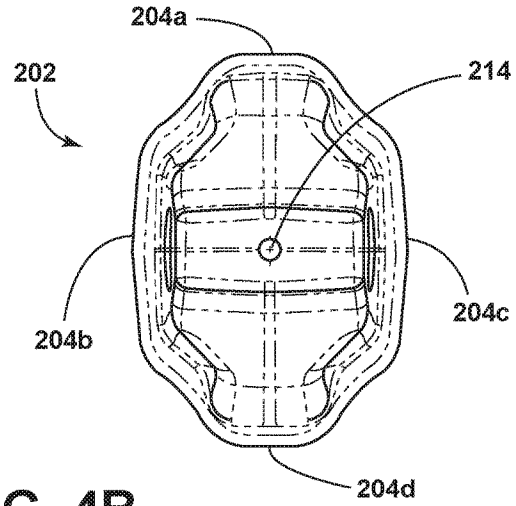
FIG. 4B is a rear view of the tooth of FIG. 4A.

FIGS. 2A-2C illustrates one embodiment of a tooth 152. The tooth 152 is formed of a rigid material, such as steel. As illustrated in FIG. 2A, the tooth 152 includes a working end 200 and a mounting end 202 opposite the working end. The working end 200 is designed to interact with a working material (for example, stone, rock, rubble, and the like). The mounting end 202 is designed to removably couple the tooth 152 to the bucket 150. In some embodiments, the mounting end 202 is attached directly to the bucket 150. In other embodiments, the mounting end 202 is attached indirectly to the bucket 150, such as through an adapter or another intermediary device that couples the tooth 152 to the bucket 150. As illustrated in FIGS. 2C and 4B, the tooth 152 also includes a top surface 204*a*, a left side surface 204*b*, a right side surface 204*c*, and a bottom surface 204*d*. As used in the present application, "left" and "right" are referenced from a point of view measured from the mounting end 202 to the working end 200. In some embodiments, the tooth 152 is molded from steel.

Figure 3:
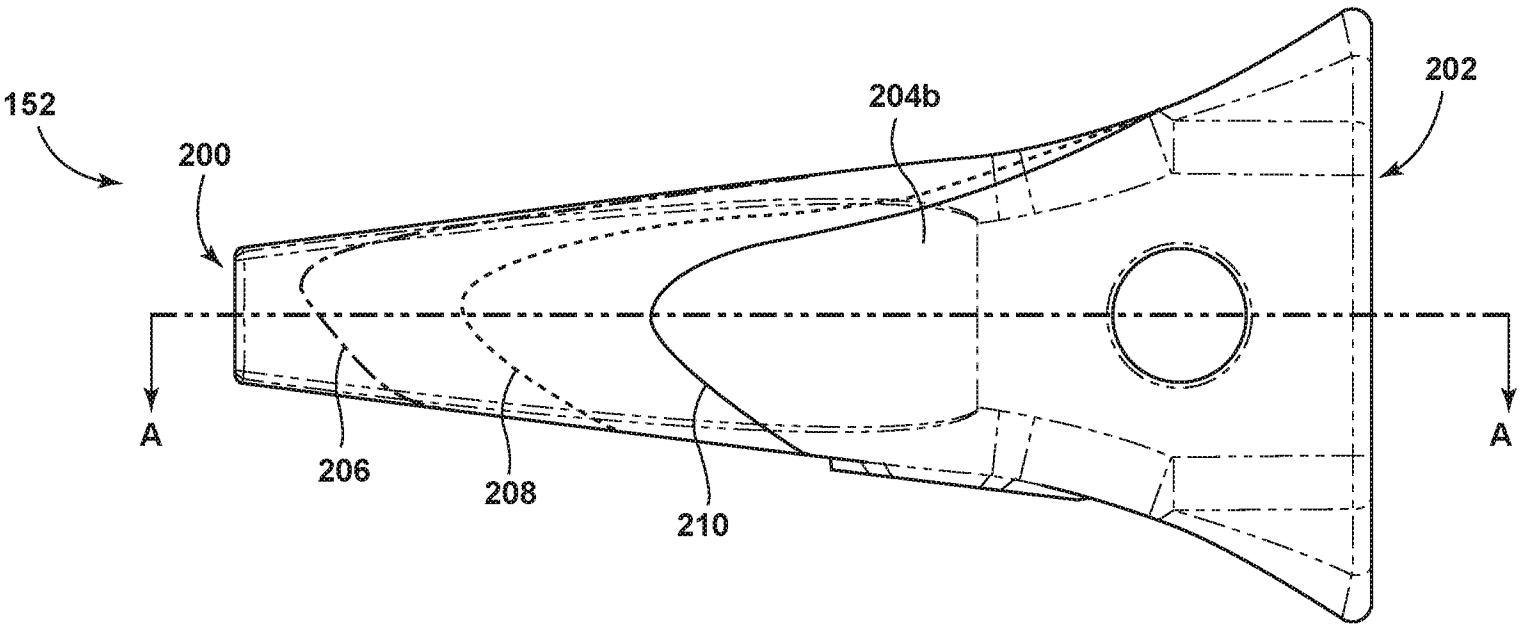
FIG. 3 is a side view of the tooth of FIG. 2A illustrating a plurality of wear levels.

As the tooth 152 is used (for example, during a digging cycle performed using the shovel 100), the tooth 152 is subjected to abrasive wear caused by interaction with the working material. The level of wear experienced by the tooth 152 depends on, for example, the working material (for example, a more abrasive material causes greater abrasive wear to the tooth 152), the duration of use of the tooth 152 (for example, a longer duration of use will cause greater wear to the tooth 152), or a combination thereof. For example, FIG. 3 illustrates a plurality of wear levels of the tooth 152. In particular, FIG. 3 illustrates a first wear level 206, a second wear level 208, and a third wear level 210 of the tooth 152. Wear levels closer to the mounting end 202 are considered higher or greater (for example, more material of the tooth 152 has worn away) than wear levels closer to the working end 200. For example, the first wear level 206 indicates a lower wear level than the second wear level 208 and the second wear level 208 indicates a lower wear level than the third wear level 210.

Figure 4A:
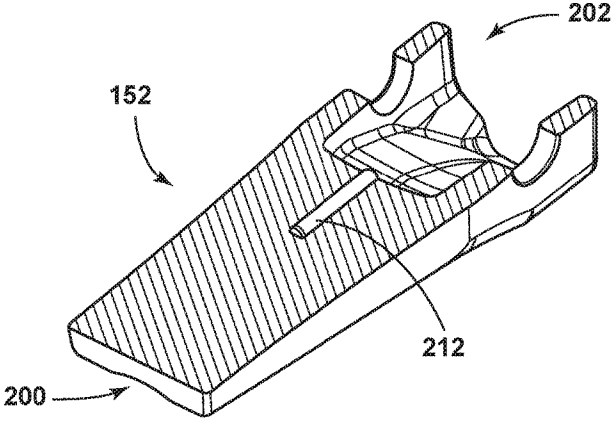
FIG. 4A is a cross-sectional view of the tooth of FIG. 2A taken along line A-A in FIG. 3 that illustrates the tooth of FIG. 2A with a single wear indicator.

As illustrated in FIG. 4A, the tooth 152 may include an embedded wear indicator 212 for detecting a current wear level of the tooth 152. As used in the present application, the term "embedded" means at least partially surrounded. Accordingly, as illustrated in FIG. 4A, in some embodiments, the wear indicator 212 is surrounded by the tooth material on all sides except for a rear surface of the wear indicator 212 facing the mounting end 202. In other embodiments, however, the wear indicator 212 is completely surrounded by the tooth material.

As illustrated in FIG. 4A, the wear indicator 212 may take the form of a cylindrical pin. However, it should be understood that the wear indicator 212 may take other shapes and configuration, such as a rectangular pin, a triangular pin, and the like. In some embodiments, the wear indicator 212 extends between the mounting end 202 and the working end 200 along a length of the tooth 152. As illustrated in FIG. 4B, in some embodiments, the wear indicator 212 is inserted into a bore 214 extending between the mounting end 202 and the working end 200, wherein the bore 214 is dimensioned to receive the wear indicator 212. In other embodiments, the wear indicator 212 is molded within the tooth 152 (for example, during molding of the tooth 152). Also, in some embodiments, the wear indicator 212 is centrally located between the top surface 204*a*, the left side surface 204*b*, the right side surface 204*c*, and the bottom surface 204*d* of the tooth 152. However, it should be understood that other positions of the wear indicator 212 are possible.

Figure 4C:
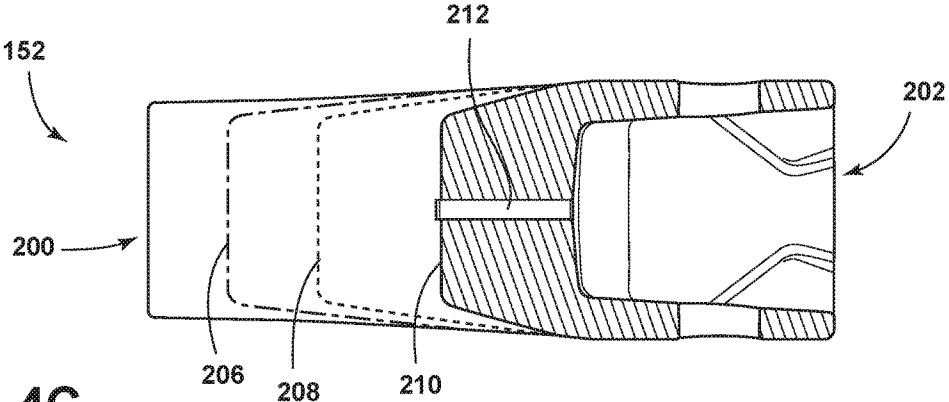
FIG. 4C is a top view of the tooth of FIG. 4A illustrating a plurality of wear levels.

As described below, the position or length of the wear indicator 212 dictates how much wear the tooth 152 is subjected to before the wear indicator 212 indicates a wear level of the tooth 152 (for example, before the wear indicator 212 indicates a need for replacement and/or maintenance of the tooth 152). For example, as illustrated in FIG. 4C, the tooth 152 must be subjected to the third wear level 210 before the wear indicator 212 is exposed and, consequently, generates an indication of tooth wear.

In some embodiments, the wear indicator 212 functions as a visual indicator. For example, as illustrated in FIG. 4A, the wear indicator 212 can extend from the mounting end 202 toward the working end 200 but not through the working end 200. Accordingly, before the tooth 152 is worn (for example, an unused tooth or a tooth with limited use) tooth material is positioned between the working end 200 and an end of the wear indicator 212 closest to the working end 200. However, as this tooth material is worn away during use of the tooth 152, the wear indicator 212, or at least a portion thereof, eventually becomes exposed and, hence is visible from an external position of the tooth 152. The wear indicator 212 can have a property that distinguishes the wear indicator 212 from the tooth material. For example, in some embodiments, the wear indicator 212 has a color different from a color of the tooth material (for example, red, yellow, or green). Alternatively or in addition, the wear indicator 212 may be composed of a material different than the tooth material (for example, copper) that also provides a distinguishing property as compared to the tooth material. The distinguishing property allows the wear indicator 212 to be visually identified (for example, by an operator, a visual inspection system, such as a camera system, or a combination thereof) and, therefore, indicate a wear level of the tooth 152. For example, a camera may capture an image of the tooth 152 and an electronic processor may be configured to process the image to detect a predetermined color, shape, or other characteristic within the image associated with the wear indicator 212, wherein whether the characteristic is detected indicates a wear level of the tooth 152. In particular, as illustrated in FIG. 4C, when the tooth 152 is at the first wear level 206 or the second wear level 208, the wear indicator 212 is not exposed and, hence, the wear indicator 212 is not visible. However, when the tooth 152 is at the third wear level 210, the wear indicator 212 is exposed and visible, which provides a visual indication that the tooth 152 should be replaced.

Figure 5A:
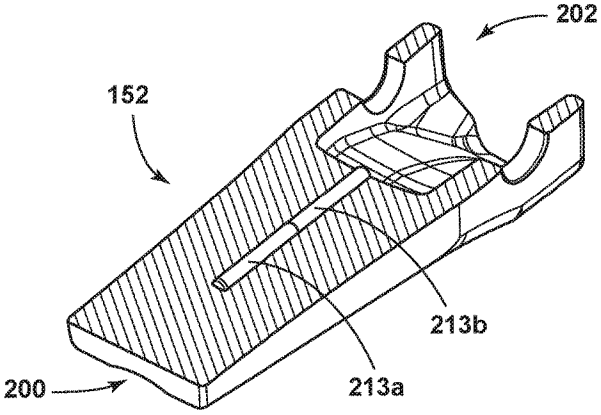
FIG. 5A is a cross-sectional view of the tooth of FIG. 2A taken along line A-A in FIG. 3 that illustrates the tooth of FIG. 2A with a single wear indicator having a plurality of sections.
Figure 5B:
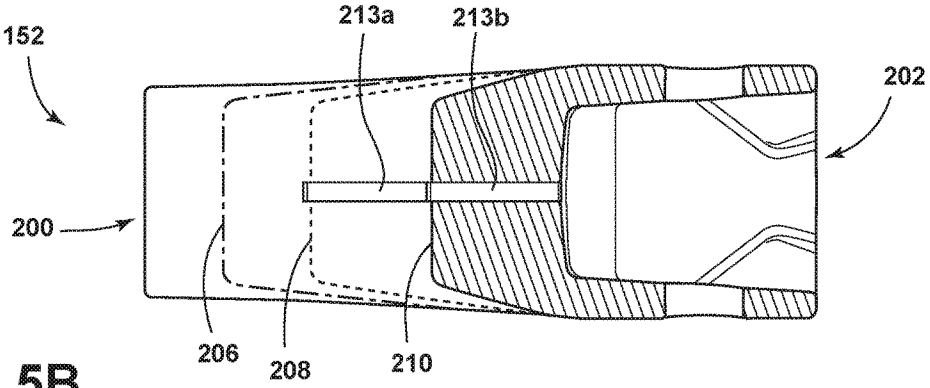
FIG. 5B is a top view of the tooth of FIG. 5A illustrating a plurality of wear levels.

In some embodiments, the distinguishing property of the wear indicator 212 varies over the length of the wear indicator 212. For example, as illustrated in FIG. 5A, the wear indicator 212 may include a plurality of sections, such as, for example, a first section 213*a* and a second section 213*b*. The first section 213*a* is closest to the working end 200 and may have a first distinguishing property (for example, a first color distinguished from the color of the tooth material) and the second section 213*b* is closest to the mounting end 202 and may have a second distinguishing property different than the first distinguishing property (for example, a second color different than the first color but also distinguished from the color of the tooth material). Accordingly, as illustrated in FIG. 5B, when the tooth 152 is not worn (for example, is unused or at the first wear level 206), neither the first section 213*a* nor the second section 213*b* is exposed. However, when the tooth 152 is at the second wear level 208, the first section 213*a* is exposed and visible but the second section 213*b* is not exposed. Also, when the tooth 152 is at the third wear level 210, both the first section 213*a* and the second section 213*b* are exposed and visible.

Accordingly, the sections of the wear indicator 212 that are exposed and visible indicate the wear level of the tooth 152 and, hence, whether the tooth 152 should be replaced. For example, in some embodiments, exposure of the first section 213*a* indicates when tooth maintenance or replacement should be planned or scheduled and exposure of the second section 213*b* indicates when tooth maintenance or replacement should be performed. It should be understood that the wear indicator 212 may include more than two sections having different distinguishing properties (for example, to indicate more than two wear levels of the tooth 152). Also, it should be understood that when the wear indicator 212 has a plurality of sections with different distinguishing properties, the wear indicator 212 may extend to and through the working end 200 even when the tooth is not worn (for example, indicating a not worn or unused state of the tooth 152).

Figure 6B:
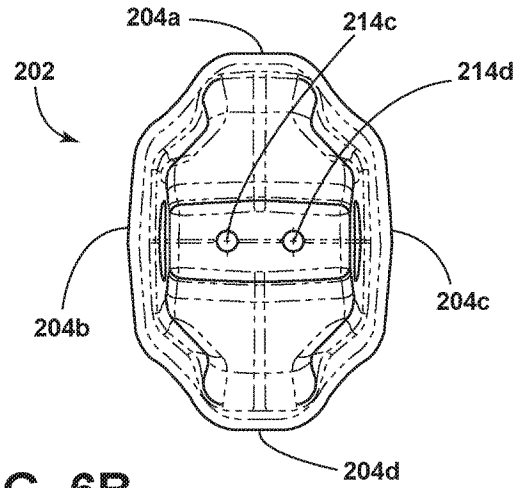
FIG. 6B is a rear view of the tooth of FIG. 6A.
Figure 6A:
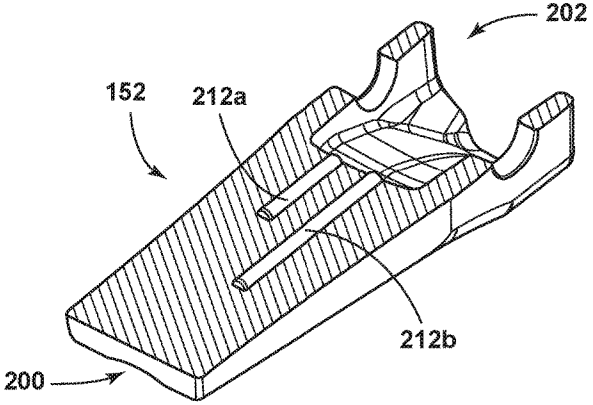
FIG. 6A is a cross-sectional view of the tooth of FIG. 2A taken along line A-A in FIG. 3 that illustrates the tooth of FIG. 2A with a plurality of wear indicators.

In some embodiments, the tooth 152 includes a plurality of wear indicators 212. For example, as illustrated in FIG. 6A, the tooth 152 may include a first wear indicator 212*c* and a second wear indicator 212*d*. It should be understood that the first and second wear indicators 212*c* and 212*d* are illustrated as one example and, in some embodiments, the tooth 152 may include more than two wear indicators 212. As illustrated in FIG. 6B, the first wear indicator 212*c* and the second wear indicator 212*d* may be positioned within separate bores (for example, a first bore 214*c* and a second bore 214*d*) within the tooth 152. Alternatively, in some embodiments, the first wear indicator 212*c* and the second wear indicator 212*d* are inserted within a common bore within the tooth 152. Also, in some embodiments, the first wear indicator 212*c* and the second wear indicator 212*d* are molded within the tooth 152.

Figure 6C:
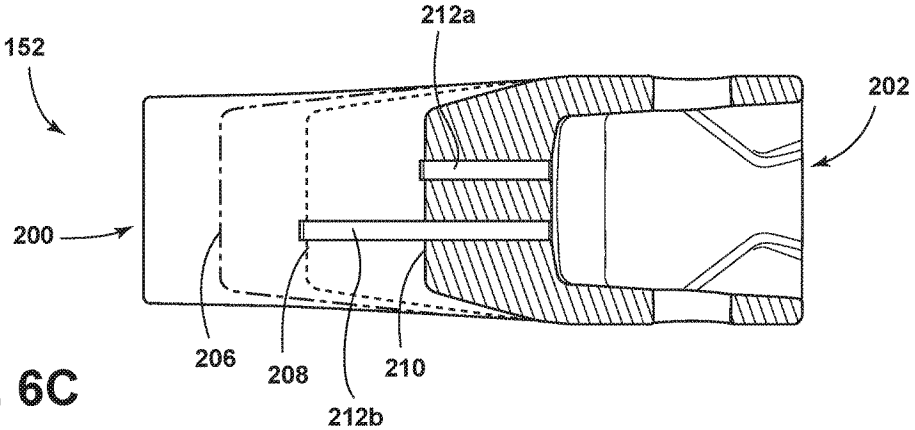
FIG. 6C is a top view of the tooth of FIG. 6A illustrating a plurality of wear levels.
Figure 6E:
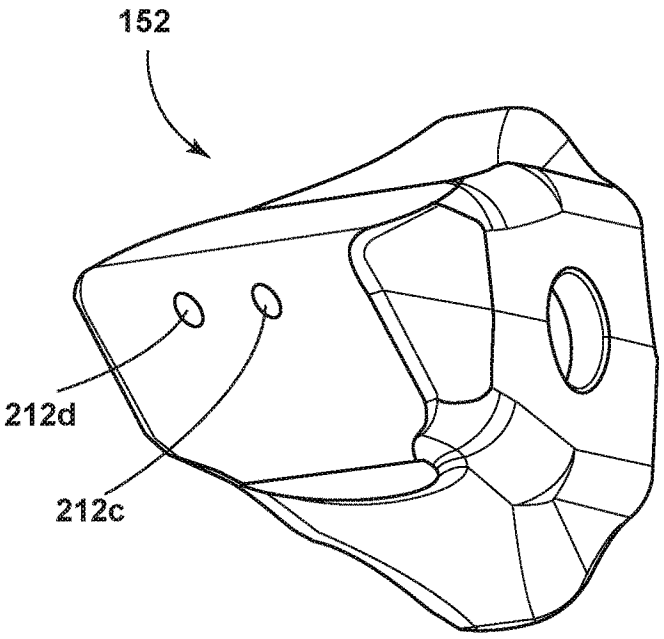
FIG. 6E is a perspective view of the tooth of FIG. 6A with two of the plurality of wear indicators exposed.
Figure 6D:
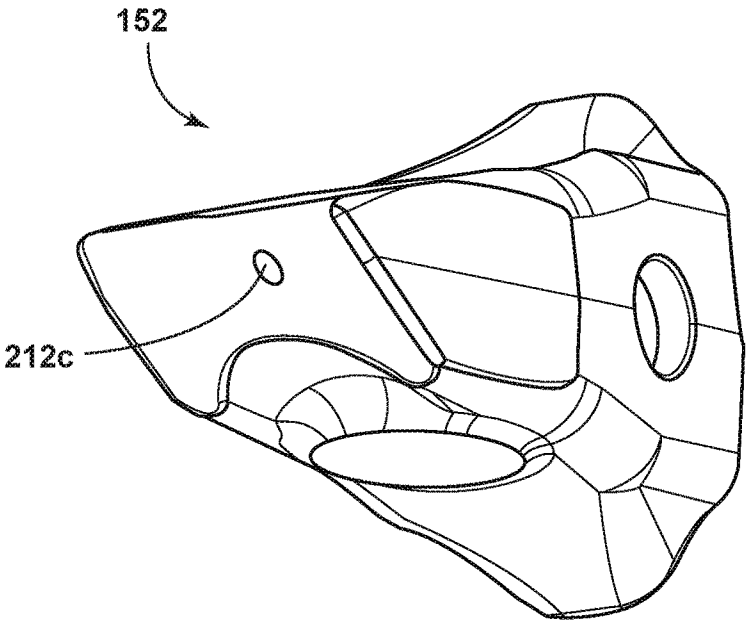
FIG. 6D is a perspective view of the tooth of FIG. 6A with one of the plurality of wear indicators exposed.

In some embodiments, the first wear indicator 212*c* is positioned parallel to the second wear indicator 212*d*. The first wear indicator 212*c* may have a different length than the second wear indicator 212*d*. For example, as illustrated in FIGS. 6A and 6C, the first wear indicator 212*c* may be longer than the second wear indicator 212*d*. Accordingly, as illustrated in FIG. 6C, when the tooth 152 is not worn (for example, the tooth 152 is unused or is at the first wear level 206), neither the first wear indicator 212*c* nor the second wear indicator 212*d* are exposed. However, as seen in FIGS. 6C and 6D, when the tooth 152 is at the second wear level 208, the first wear indicator 212*c* is exposed and visible but the second wear indicator 212*d* is not exposed. Similarly, as seen in FIGS. 6C and 6E, when the tooth 152 is at the third wear level 210, both the first wear indicator 212*c* and the second wear indicator 212*d* are exposed and visible. Accordingly, the first wear indicator 212*c* may indicate when tooth maintenance or replacement should be planned, and the second wear indicator 212*d* may indicate when tooth maintenance or replacement should be performed. In some embodiments, in addition to having different lengths, the first wear indicator 212*c* and the second wear indicator 212*d* have different distinguishing properties (for example, different colors). Also, in some embodiments, the first wear indicator 212*c*, the second wear indicator 212*d*, or both include a plurality of sections having different distinguishing properties, as described above with respect to FIGS. 5A and 5B. Also, in some embodiments, when the tooth 152 includes a plurality of wear indicators 212, one of the plurality of wear indicators 212 extends to and through the working end 200 of the tooth 152 when the tooth 152 is not worn (for example, to indicate a not worn or unused state of the tooth 152). When the tooth 152 includes a plurality of wear indicators 212 or a wear indicator 212 with a plurality of sections, the emergence of each indicator or section may represent a unique level of wear of the tooth 152, which may be used to forewarn an operator before a critical wear state has been reached.

Figure 7A:
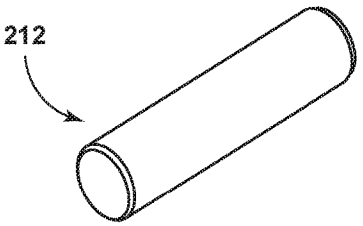
FIG. 7A is a perspective view of a wear indicator included in the tooth of FIG. 2A.
Figure 7B:
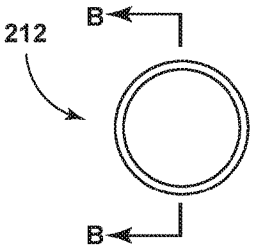
FIG. 7B is a front view of the wear indicator of FIG. 7A.
Figure 7C:
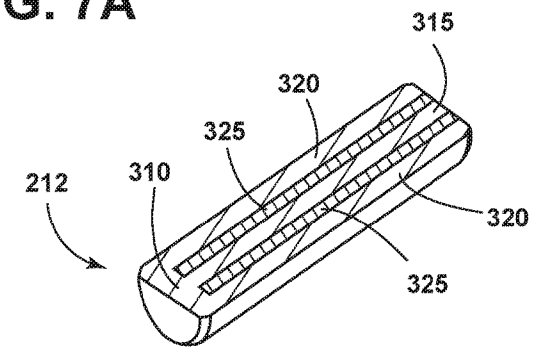
FIGS. 7C and 7D are cross-sectional views of the wear indicator of FIG. 7A taken along line B-B in FIG. 7B.
Figure 7D:
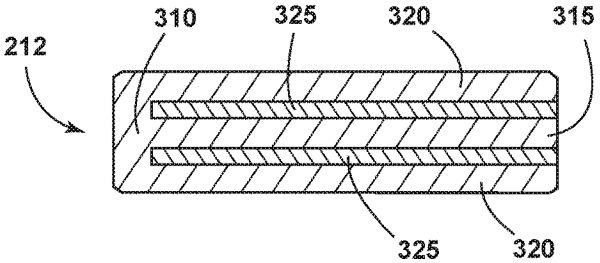
Figure 7E:
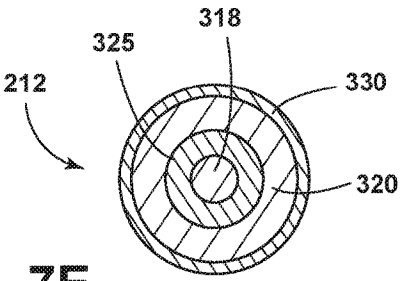
FIG. 7E is a rear view of the wear indicator of FIG. 7A.

In some embodiments, the wear indicator 212 includes an electric circuit. For example, as illustrated in FIGS. 7A-7E, the wear indicator 212 may include a conductive tip 310, a conductive outer body 320 extending along at least a length of the heavy machine tooth defined between the working end 200 and the mounting end 202 of the tooth 152, a conductive inner core 315 positioned within the conductive outer body 320, and insulating material 325 positioned between the conductive outer body 320 and the conductive inner core 315. The conductive tip 310 is positioned between the working end 200 of the tooth 152 and the conductive outer body 320 and electrically couples the conductive outer body 320 and the conductive inner core 315 to complete an electric circuit. As illustrated in FIGS. 7C-7D, the conductive inner core 315 may include cylindrically-shaped conductive material, and the conductive outer body 320 may include ring-shaped conductive material. With the exception of the conductive tip 310, the conductive inner core 315 is electrically separated from the conductive outer body 320 by the insulating material 325, which may include ring-shaped insulating material. In some embodiments, as seen in FIG. 7E, second insulating material 330 is provided over at least a portion of the external surface of the wear indicator 212 to insulate the wear indicator 212 from the material that forms the tooth 152. The conductive tip 310, the conductive outer body 320, and the conductive inner core 315 may be constructed from any type of conducting material, such as, for example, steel, brass, aluminum, and the like and may be constructed of the same conductive material or different conductive material. Also, in some embodiments, the conductive outer body 320 and the second insulating material 330 of the wear indicator 212 are eliminated. For example, the wear indicator 212 may include the conductive tip 310, the conductive inner core 315, and the insulating material 325 surrounding the conductive inner core 315. In this configuration, the material forming the tooth 152 functions as the conductive outer body 320 to form the electric circuit.

In some embodiments, the tooth 152 includes an internal power source (not shown), such as a battery, that supplies electric current to the electric circuit defined by the wear indicator 212. In other embodiments, a power source external to the tooth 152 provides electric current to the electric circuit (using external wiring). When the conductive tip 310 electrically couples the conductive outer body 320 and the conductive inner core 315, the electric circuit is in a closed state and electric current runs through the electric circuit. However, when the conductive tip 310 is destroyed as a result of wear of the tooth 152, the electric circuit is in an open state. For example, in some embodiments, the conductive tip 310 is thin relative to the length of the wear indicator 212 and, therefore, is worn away quickly after the wear indicator 212 is exposed due to wear of the tooth 152 (for example, approximately simultaneously).

The tooth 152 may include a sensor for detecting a state of the electric circuit (for example, opened or closed). In some embodiments, the sensor includes a current sensor. When the current sensor detects current in the electric circuit, the electric circuit is closed. When the current sensor does not detect current in the electric circuit, the electric circuit is open. It should be understood that other types of sensors may be used to detect a state of the electric circuit, including, for example, voltmeters, a Wheatstone bridge, and the like, through detecting current, voltage, or another characteristic of the electric circuit. Furthermore, as described in more detail below, the electric circuit may be used to supply power to a transmitter. Accordingly, rather than directly detecting a state of the electric circuit using a sensor, the presence or absence of a signal from the transmitter may indirectly indicate a state of the electric circuit.

Figure 8:
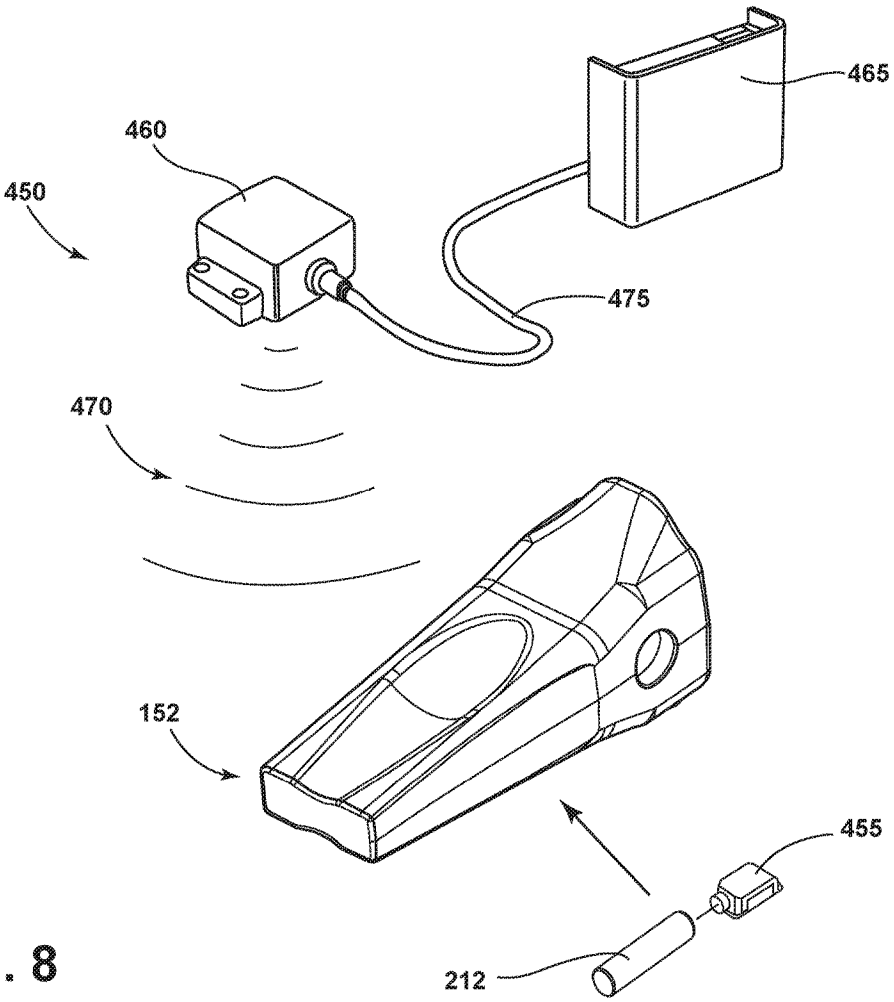
FIG. 8 schematically illustrates a wear detection system.

The detected state of the electric circuit defined by the wear indicator 212 may be transmitted to an external device. For example, FIG. 8 illustrates a transmitter 455. The transmitter 455 may communicate with the wear indicator 212 or other components included in the tooth 152. For example, the transmitter 455 may communicate with the electric circuit or a sensor detecting a state of the electric circuit. In some embodiments, the transmitter 455 or a portion thereof may be embedded within the tooth 152. Alternatively, the transmitter 455 may be external to the tooth 152 and may communicate with components included in the tooth 152 over a wired connection.

In some embodiments, the transmitter 455 includes an active or passive radio-frequency identification (RFID) transponder (for example, an ultra-high frequency RFID transponder). However, in other embodiments, the transmitter 455 communicates data using other types of short-range or long-range wireless communication protocols, such as but not limited to Wi-Fi, Zigbee, or Bluetooth. Also, as noted above, in some embodiments, the transmitter 455 is configured to communicate data to an external device over a wired connection.

As illustrated in FIG. 8, the transmitter 455 communicates data to a first receiver 460 over a wireless or wired connection 470. For example, in some embodiments, the first receiver 460 is an RFID reader. The first receiver 460 may be mounted in a position removed from the transmitter 455, for example, at a distance of approximately six meters from the heavy machine tooth 152. Positioning the first receiver 460 at this distance protects the first receiver 460 from impact with the working material and other digging hazards while keeping the first receiver 460 close to the transmitter 455 to receive transmitted data. In some embodiments, the first receiver 460 may be mounted on the shovel 100, such as on the boom 125 of the shovel 100.

The transmitter 455 is configured to transmit a detected state of the electric circuit to the first receiver 460. In some embodiments, the transmitter 455 may also store the detected state of the electric circuit, such as in non-transitory, computer-readable medium included in the tooth 152 (for example, included in the transmitter 455) or external to the tooth 152. In some embodiments, the transmitter 455 transmits raw data regarding the detected state of the electric circuit. In other embodiments, the transmitter 455 (for example, an electronic processor included in the transmitter 455 or separate from the transmitter 455) processes the raw data prior to transmitting the data (for example, to perform filtering, conditioning, mapping, and the like). For example, in some embodiments, the detected state of the electric circuit is represented as current through the electric circuit detected by a current sensor. Accordingly, in these embodiments, the transmitter 455 may be configured to transmit the detected current, a processed version of the detected current, or a state of the electric circuit that maps to the detected current (for example, "open" when the detected current is approximately zero and "closed" when the detected current is greater than zero).

Furthermore, as noted above, in some embodiments, power may be supplied to the transmitter 455 through the electric circuit defined by the wear indicator 212. Accordingly, when the electric circuit is closed, the transmitter 455 receives power and uses the received power to transmit a signal to the first receiver 460. However, when the electric circuit is open, the transmitter 455 does not receive power and, hence, cannot transmit a signal. Therefore, whether the first receiver 460 receives a signal from the transmitter 455 may indirectly indicate a detected state of the electric circuit. In particular, when a signal is received from the transmitter 455, the electric circuit may be closed, and, when a signal is not received from the transmitter 455, electric circuit may be open. Also, in some embodiments, passive RFID is used to provide power to the transmitter 455. For example, an RFID reader included in the first receiver 460 may provide power to the transmitter 455, which includes a passive RFID transponder. The transmitter 455 uses the induced power to transmit a signal, which as described above, can be used to directly or indirectly indicate a state of the electric circuit. Accordingly, when the transmitter 455 includes a passive RFID transponder, the transmitter 455 may not require a wired power supply.

As illustrated in FIG. 8, in some embodiments, the first receiver 460 also communicates with a second receiver 465 (for example, over a wired or wireless connection 475). The second receiver 465 may be positioned on the shovel 100 or positioned remote from the shovel 100. For example, in some embodiments, the transmitter 455 communicates with the first receiver 460 using short-range wireless communication protocols to control power requirements for the transmitter 455. However, when data is needed at a further distance from the tooth 152, such as remote from the shovel 100, the first receiver 460 may relay received data to the second receiver 465 positioned at these locations. It should be understood that the second receiver 465 may be combined with the first receiver 460 (for example, contained within a common housing). Also, in some embodiments, the transmitter 455 may be configured to directly communicate with the second receiver 465 without using the first receiver 460. Further, the functionality performed by the second receiver 465 described below may be distributed among a plurality of devices (for example, multiple electronic processors), including the transmitter 455, the first receiver 460, or a combination thereof. When the first receiver 460 communicates data to the second receiver 465, the first receiver 460 may process data received from the transmitter 455 prior to communicating the data as described with respect to the transmitter 455 (for example, to perform filtering, conditioning, mapping, and the like).

The second receiver 465 may include an electronic processor (not shown) configured to execute instructions to process received data. In some embodiments, the second receiver 465 also obtains data from other sources, such as other sensors, systems, transmitters, and the like, included in the shovel 100 or the mining environment that the second receiver 465 uses to process received data. For example, the second receiver 465 may process received data to determine a wear level of the tooth 152. In particular, when the data received by the second receiver 465 includes a state of the electric circuit defined by the wear indicator 212, the electronic processor included in the second receiver 465 may use the state of the electric circuit to determine a wear level of the tooth 152. For example, as illustrated in FIG. 4C, when the tooth 152 is not worn or is worn to the first wear level 206 or the second wear level 208, the conductive tip 310 is not exposed and, therefore, the conductive tip 310 remains intact closing the electric circuit. However, when the tooth 152 is at the third wear level 210, the conductive tip 310 is exposed and is destroyed, which opens the electric circuit defined by the wear indicator 212.

After determining a wear level of the tooth 152, the second receiver 465 may automatically perform one or more actions. The automatic actions may include, for example, generating warnings and alerts, generating and transmitting communications, logging data for later mining or analysis, or a combination thereof. The alerts may include, for example, an audio alert, a visual alert, a tactile alert, or a combination thereof. In some embodiments, the alerts are provided through an operator interface on the shovel 100 or at a remote station. Alternatively or in addition, the automatic action may include automatically controlling operation of the shovel 100. For example, operation of the shovel 100 may be automatically stopped or slowed to allow for inspection, maintenance, replacement, or a combination thereof. For example, operation of the shovel 100 may be automatically stopped or slowed to check for and locate a tooth 152 that has become detached from the shovel 100.

Figure 9:
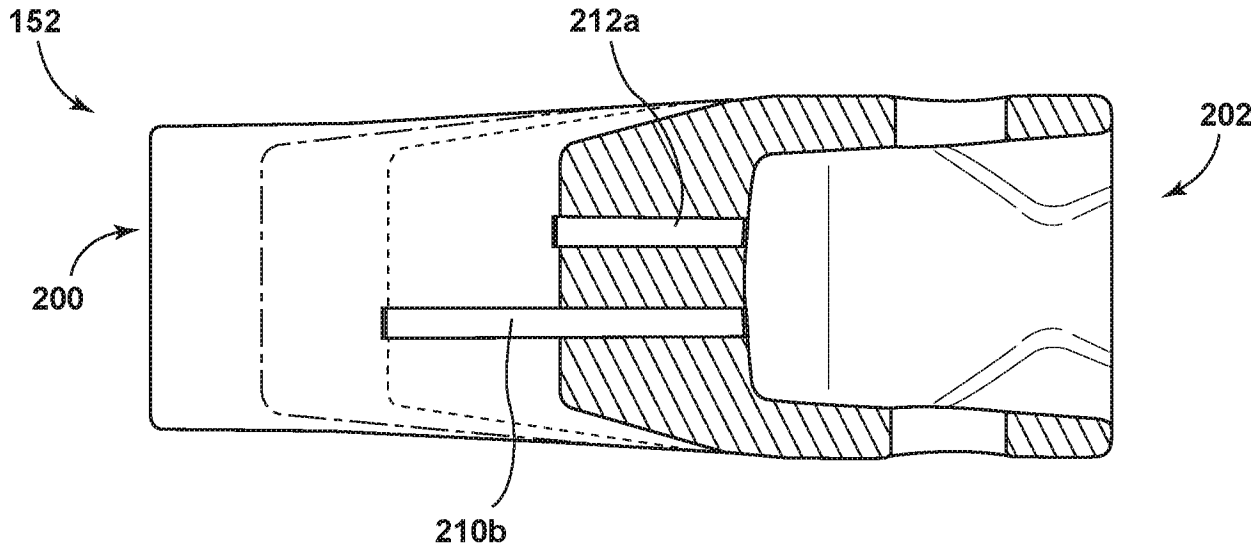
FIG. 9 is a cross-sectional view of the tooth of FIG. 2A taken along line A-A in FIG. 3 that illustrates two wear indicators of FIG. 7A where each wear indicator has a different length.

In some embodiments, the tooth 152 may include a plurality of wear indicators wherein each of the plurality of wear indicators 212 includes an electric circuit as described above. For example, as illustrated in FIG. 9, the tooth 152 may include a first wear indicator 212*a* and a second wear indicator 212*b*. The first wear indicator 212*a* may include a first conductive tip, a first conductive outer body, a first conductive inner core positioned within the first conductive outer body, and first insulating material positioned between the first conductive outer body and the first conductive inner core as described above. The first conductive tip is positioned between the working end 200 and the first conductive outer body at a first distance from the working end 200, and, as described above, the first conductive tip electrically couples the first conductive outer body and the first conductive inner core to form a first electric circuit.

Similarly, the second wear indicator 212*b* may include a second conductive tip, a second conductive outer body, a second conductive inner core positioned within the second conductive outer body, and second insulating material positioned between the second conductive outer body and the second conductive inner core. The second conductive tip is positioned between the working end 200 and the second conductive outer body at a second distance from the working end 200 different than the first distance, and, as described above, the second conductive tip electrically couples the second conductive outer body and the second conductive inner core to form a second electric circuit.

Accordingly, as the tooth 152 wears, the electric circuits included in the first and second wear indicators 212*a* and 212*b* are opened at different levels of wear. Thus, the transmitter 455 (or separate transmitters for each of the plurality of wear indicators 212) may transmit a state of each electric circuit and the first receiver 460, the second receiver 465, or both may use the detected state of each electric circuit to determine a current wear level of the tooth 152. For example, when the electric circuit included in the first wear indicator 212*a* is opened but the electric circuit included in the second wear indicator 212*b* is closed, the first receiver 460, the second receiver 465, or both may determine that the tooth 152 is worn to at least the first distance but has not yet worn to the second distance. As noted above, when multiple wear indicators 212 are included in a signal tooth, a single transmitter 455 or multiple transmitters 455 may be used to transmit data regarding the electric circuits. In some embodiments, a separate transmitter 455 may be used for each electric circuit, which allows each transmitter to receive electric current through a separate electric circuit as described above.

Figure 10A:
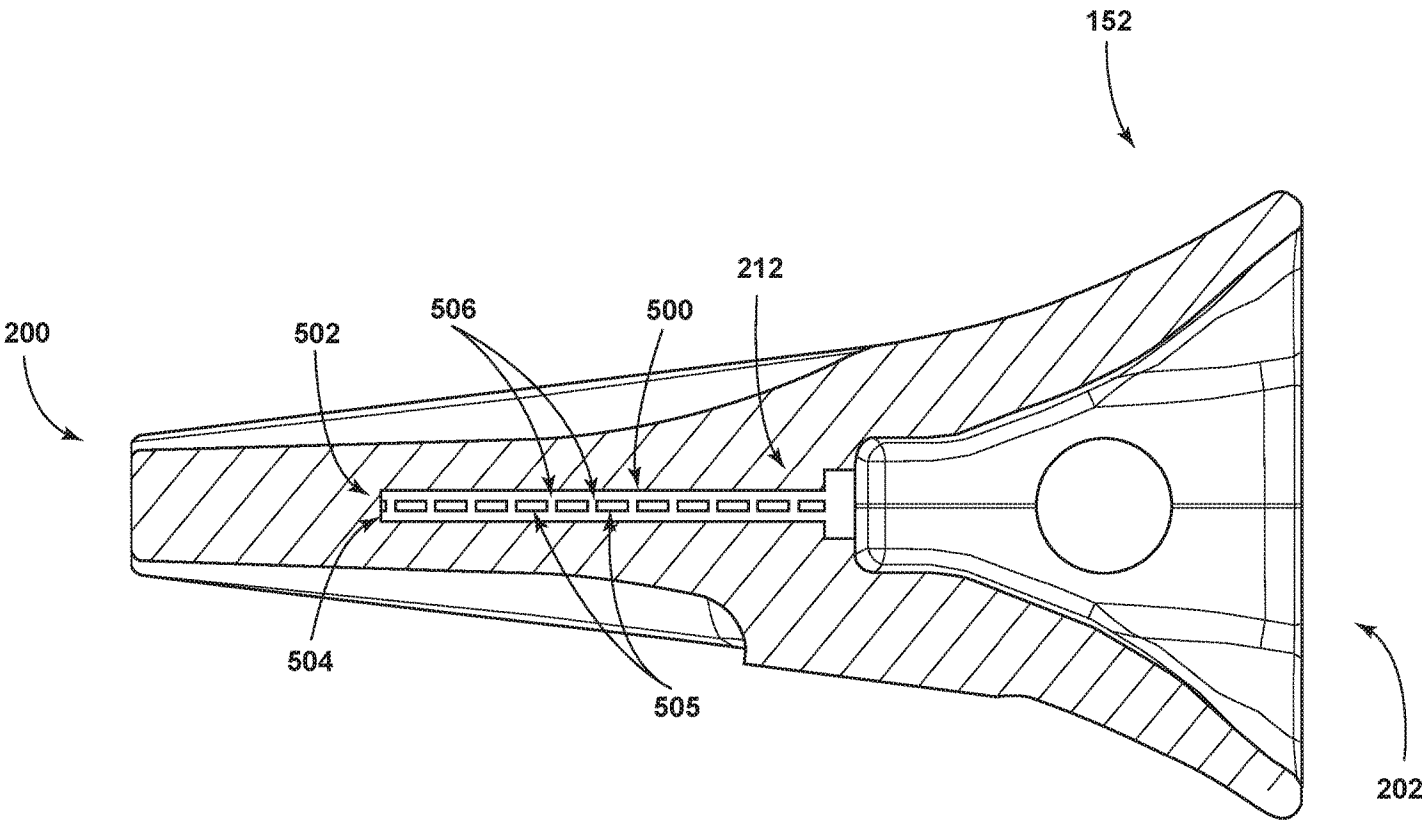
FIGS. 10A and 10B are cross-sectional views of the tooth of FIG. 2A with a wear indicator having an embedded variable resistive circuit.

Alternatively or in addition, in some embodiments, a single wear indicator 212 may define multiple electric circuits. For example, FIG. 10A illustrates the wear indicator 212 defining a variable resistance circuit 500. The variable resistance circuit 500 is constructed of conductive material, and, in some embodiments, includes an upper conductive body 502 and a lower conductive body 504 separately by insulating material 505. The upper conductive body 502 and the lower conductive body 504 may be positioned approximately parallel to each other along a length of the tooth 152 defined between the working end 200 and the mounting end 202.

As illustrated in FIG. 10A, the upper conductive body 502 and the lower conductive body 504 are electrically coupled by a plurality of conductive walls 506 that define a plurality of electrical pathways through the variable resistive circuit 500. In some embodiments, the plurality of conductive walls 506 are positioned along a length of the tooth 152 defined between the working end 200 and the mounting end 202. Also, in some embodiments, each of the plurality of conductive walls 506 is positioned approximately perpendicular to the upper conductive body 502 and the lower conductive body 504. However, it should be understood that the conductive walls 506 may connect the upper conductive body 502 and the lower conductive body 504 in other manners and may have a variety of shapes, sizes, and configurations.

Each of the plurality of conductive walls 506 may be associated with a predetermined resistive value and, in some embodiments, each of the plurality of conductive walls 506 may be associated with the same or a different resistive value. In some embodiments, each of the plurality of conductive walls 506 is constructed from the same or different conductive materials. Initially, before the tooth 152 is worn, when electric current is supplied to the variable resistance circuit 500, the electric current flows through the variable resistive circuit 500 between the upper conductive body 502 and the lower conductive body 504 through each of the plurality of conductive walls 506 (through each of the electrical pathways defined by the plurality of conductive walls 506). Alternatively, when electric current is supplied to the variable resistive circuit 500, the electric current flows through at least the conductive wall 506 closest to the working end 200. As the tooth 152 wears, portions of the upper conductive body 502 and the lower conductive body 504 are also worn and destroyed as are individual conductive walls 506. Thus, as the tooth 152 wears, the supplied electric current passes through a variable number of conductive walls 506 or a different conductive wall as conductive walls 506 are destroyed. The number of conductive walls 506 or the individual conductive walls 506 that the electric current passes through impacts the resistance of the variable resistive circuit 500. Accordingly, the tooth 152 may include a sensor, such as a current sensor, that detects the resistance of the variable resistive circuit 500, which may be translated into a particular wear level.

In some embodiments, the variable resistive circuit 500 is isolated from the material forming the tooth 152, such as with a layer of insulating material. Accordingly, in these embodiments, the detected resistance of the variable resistive circuit 500 is not impacted by the tooth. Without the insulation, the material composition and permittivity of the tooth 152, shape of the tooth 152, and the like may impact the detected resistance and increase the complexity of mapping a detected resistance to a particular wear level. Accordingly, detecting the resistance value of the variable resistive circuit 500 isolated from other components of the tooth 152 may allow for greater accuracy and repeatability.

Figure 10B:
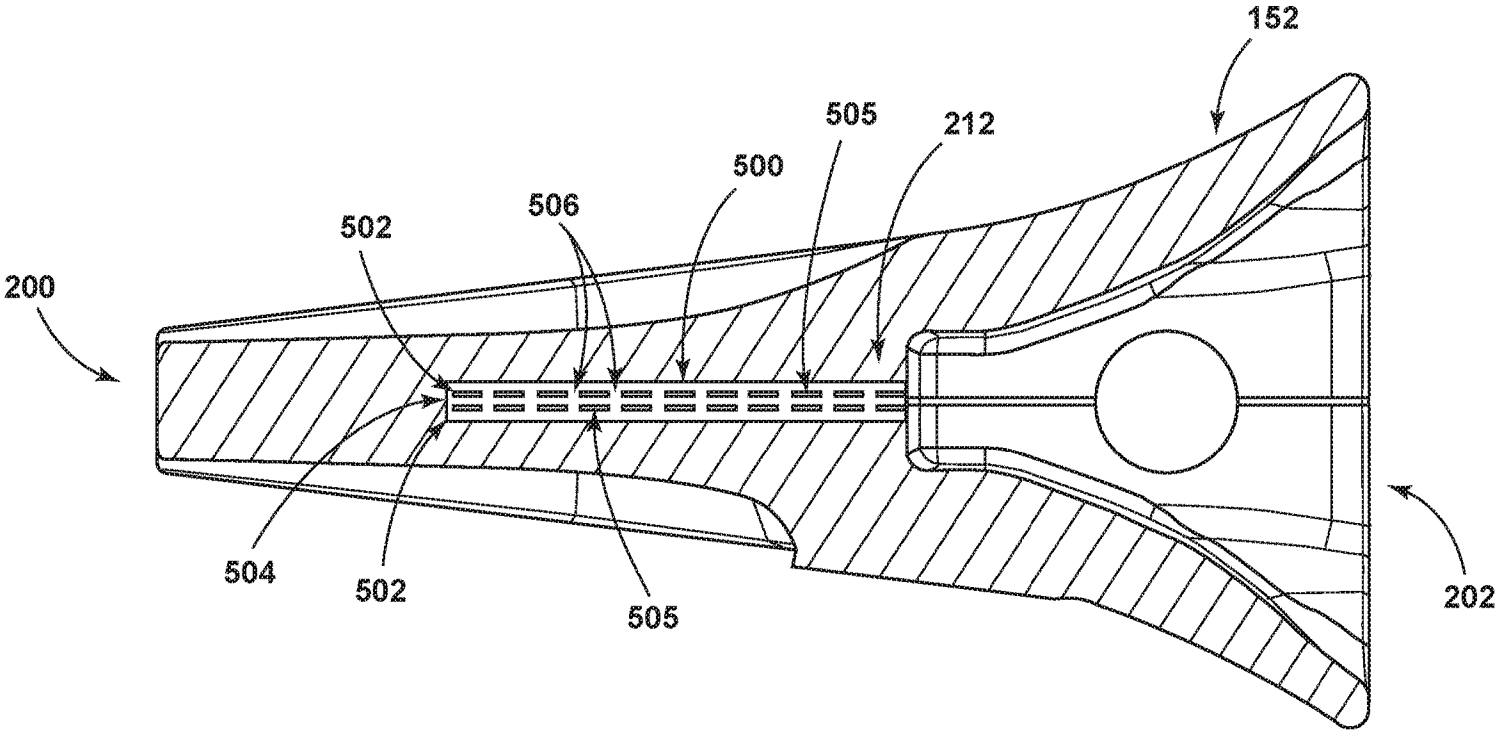
Figure 10C:
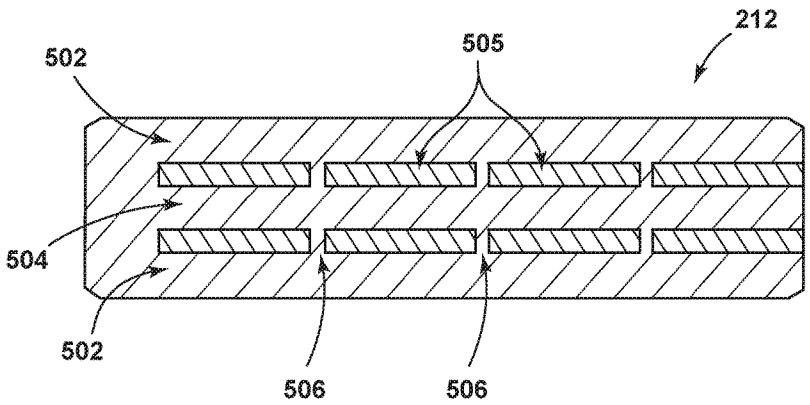
FIGS. 10C and 10D are cross-sectional views of the wear indicator of FIG. 10B.
Figure 10D:
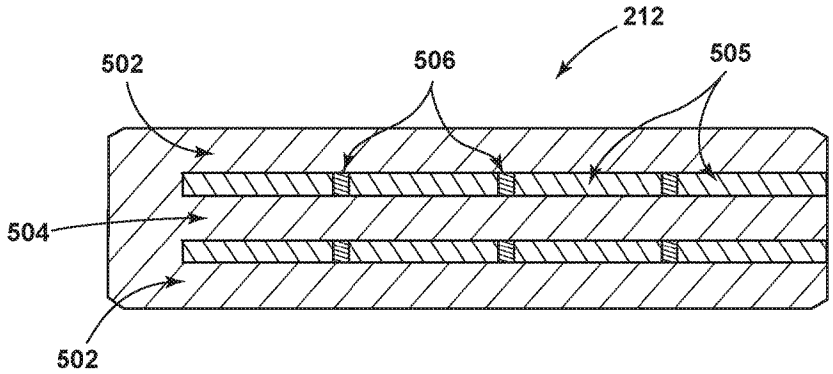

The upper conductive body 502, the lower conductive body 504, and the insulating material 505 may be constructed as generally planar bodies as illustrated in FIG. 10A. Alternatively, the upper conductive body 502, the lower conductive body 504, the insulating material 505, or a combination thereof may be shaped or positioned differently. For example, the upper conductive body 502, the lower conductive body 504, and the insulating material 505 may be cylindrically-shaped similar to the wear indicator 212 described above with respect to FIGS. 7A-7E. In particular, as illustrated in FIG. 10B, the upper conductive body 502 may be cylindrically-shaped similar to the conductive outer body 320 as described above, the lower conductive body 504 may be cylindrically-shaped similar to the conductive inner core 315 as described above, and the insulating material 505 may include cylindrically-shaped portions positioned between the upper conductive body 502 and the lower conductive body 504. In this embodiment, each of the plurality of conductive walls 506 connect the inner surface of the upper conductive body 502 with outer surface of the lower conductive body 504 similar to the conductive tip 310 described above. Thus, in these embodiments, rather than including only a single conductive tip 310 as described above, the plurality of conductive walls 506 provide multiple electric pathways that allow multiple wear levels to be detected. As noted above, one or more of the conductive walls 506 may include the same load or a different load to define the same or a different resistive value for each conductive wall 506. As also noted above, one or more of the conductive walls 506 may be constructed from the same material as the upper conductive body 502, the lower conductive body 504, or both (see FIG. 10C) or may be constructed from different material than the upper conductive body 502, the lower conductive body 504, or both (see FIG. 10D).

After detecting the resistance of the variable resistive circuit 500, the transmitter 455 may transmit the detected resistance (or a processed version of the same including a number of conductive walls 506 that have been destroyed or remain within the variable resistive circuit 500 that is mapped to the detected resistance) to the first receiver 460, the second receiver 465, or both as described above. The first receiver 460, the second receiver 465, or both may use the received resistance data to determine a wear level of the tooth 152 and take one or more automatic actions as also described above. Thus, rather than monitoring for merely an open or closed state of an electric circuit, which only indicate two different wear level of a tooth, the variable resistance circuit 500 allows the resistance of an electric circuit to be monitored for a plurality of different resistance values, which may indicate a plurality of different wear levels of a tooth.

It should be understood that, in some embodiments, a wear indicator 212 functions as both a visual indicator and an electrical indicator to provide dual identification of a wear level. For example, the conductive outer body 320, the conductive inner core 315, the conductive tip 310, or a combination thereof may be constructed from a conducting material that is visually distinguishable from the material of the tooth 152. The conducting material may be, for example, brass, which is highly conductive due to the high copper content but also has a yellow color due to the chemical composition of brass that is distinguished from the material of the tooth 152 (for example, steel). Accordingly, when the wear indicator 212 is exposed, the wear indicator 212 may provide a visual indication of a wear level of the tooth 152 in addition to providing an electrical indication of the current wear level of the tooth 152. Similarly, the insulating material 325 or the second insulating material 330 may be visually distinguishable from the material of the tooth 152 (for example, have a different color). For example, the color of the material of the tooth 152 may be different than the color of the insulating materials 325 and 330. Accordingly, when the conductive tip 310 wears away, the insulating materials 325 and 330 are visible, which provides an indication of the wear level of the tooth 152. The insulating material 325, the second insulating material 330, the conductive outer body 320, the conductive inner core 315, the conductive tip 310, or a combination thereof may similarly have sections with different distinguishing properties (for example, different colors, different materials, and the like), as described above with respect to FIGS. 5A and 5B.

Also, in some embodiments, the tooth 152 includes a first wear indicator that functions as a visual indicator and a second wear indicator that functions as an electrical indicator. For example, as illustrated in FIGS. 6A and 6C, the first wear indicator 212*c* may be a visual wear indicator and the second wear indicator 212*d* may be an electrical wear indicator. Similarly, the tooth 152 may include a wear indicator 212 that includes a first section 213*a* that functions solely as a visual indicator and a second section 213*b* that functions solely as an electrical indicator. For example, as illustrated in FIGS. 5A and 5B, the first section 213*a* may be a visual wear indicator and the second section 213*b* may be an electrical wear indicator.

Providing such a dual indication of the current wear level of the tooth 152 through a visual indicator and an electrical indicator provides a more robust and reliable wear level indication than a single identification of a wear level. For example, a visual indication and an electrical indication may be compared to verify the wear level of the tooth 152. When the indications do not match, an alert may not be generated. Accordingly, comparisons of the visual indications and the electrical indications may be used to determine an error, a failure, a malfunction, or a combination thereof with the wear indicator 212 or other devices included in the wear detection system 450.

Figure 11:
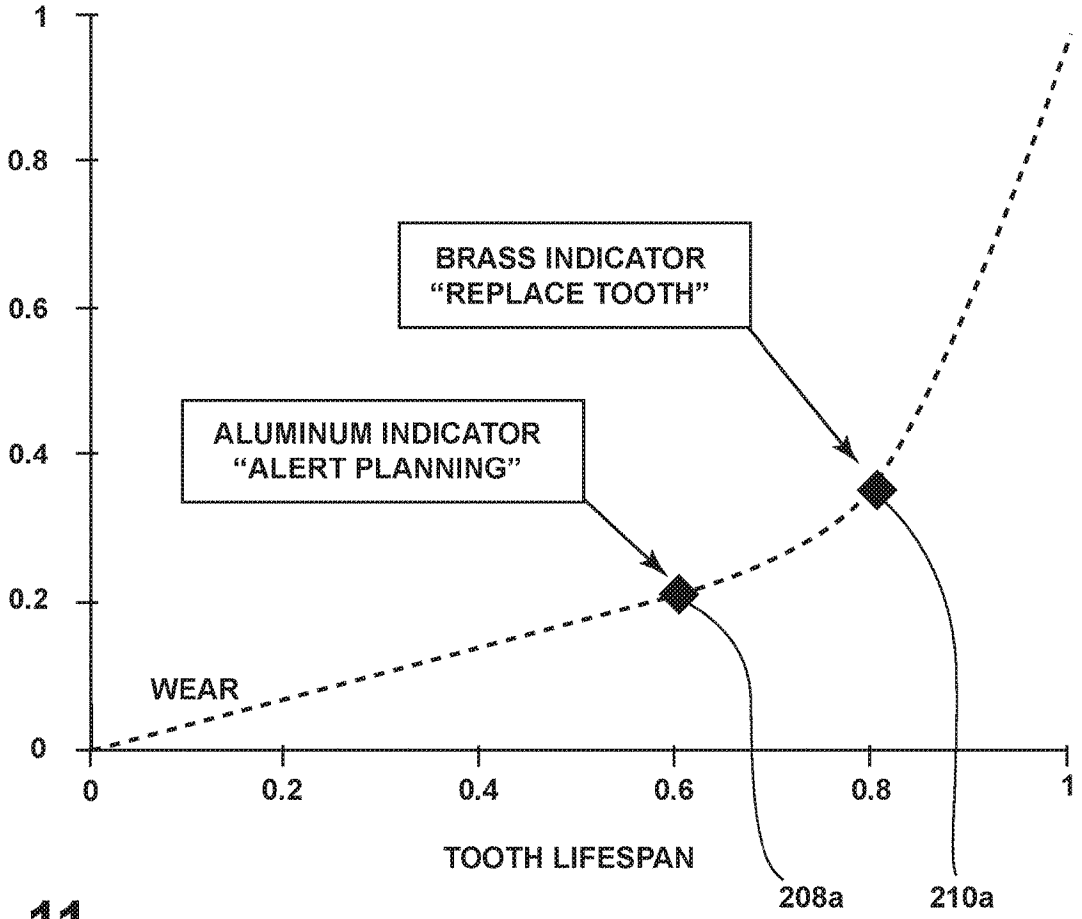
FIGS. 11 and 12 are charts illustrating example relationships between productivity and tooth maintenance or replacement.
Figure 12:
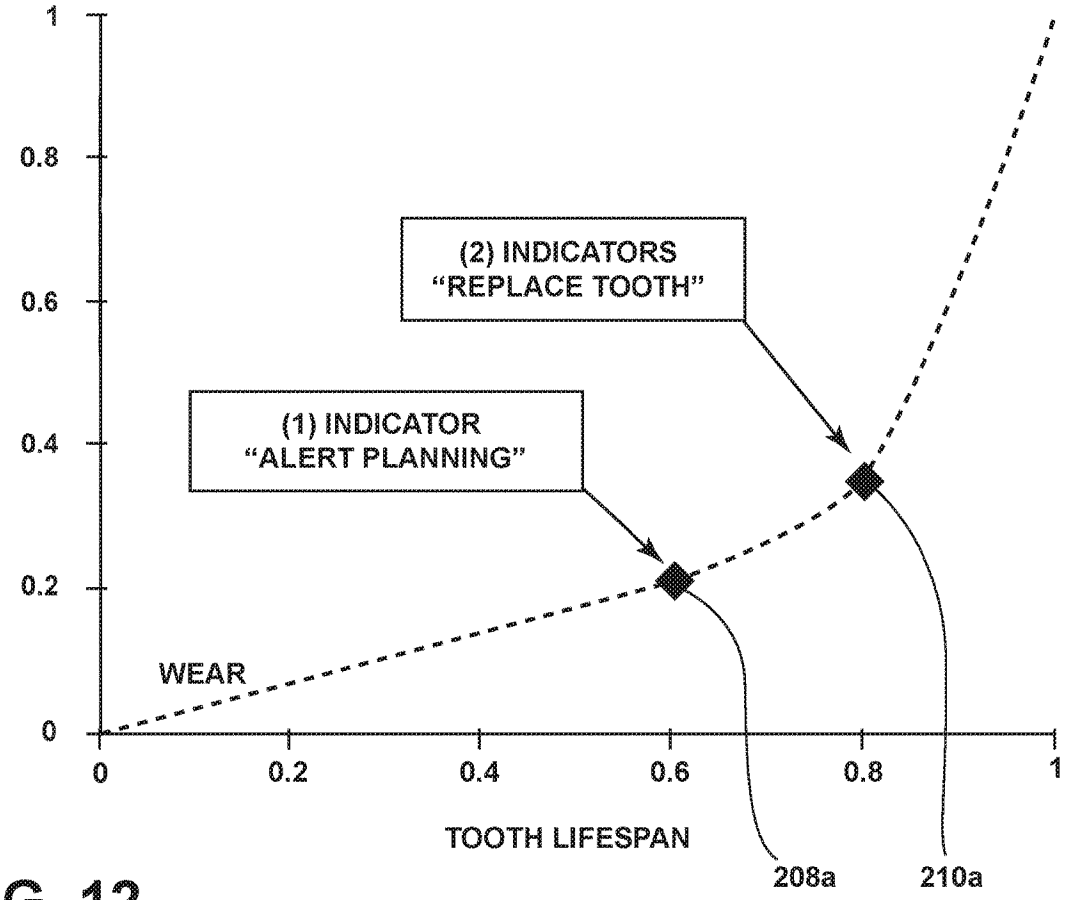

Furthermore, as noted above, using a plurality of wear indicators 212 or a wear indicator 212 with a plurality of distinguishing sections allows a plurality of wear levels to be identified. Therefore, unexpected maintenance may be reduced or avoided while simultaneously allowing an unexperienced operator to optimize productivity and schedule downtime of the shovel 100. For example, one or more wear indicators 212 may be configured to track milestones in a lifecycle of the tooth 152 and forewarn of replacement of the tooth 152 (for example, the wear levels as illustrated in FIGS. 3, 4C, 5B, and 6C). The wear indicators 212 may also be designed based on productivity of the shovel 100, as illustrated in FIGS. 11 and 12. For example, one or more wear indicators 212 may be used to identify the following milestones: (a) advanced alert to planning/logistics to schedule replacement of the tooth 152; (b) productivity optimized tooth discard; (c) 50% productivity loss; and (d) critical tooth wear level for failure.

For example, when a first wear indicator 212*a* and a second wear indicator 212*b* are included in a tooth 152, the first wear indicator 212*a* becomes exposed at the second wear level 208, as illustrated in FIG. 6A. When this occurs, an "Alert Planning" indication may be triggered (at point 208*a*) as shown in FIGS. 11 and 12. Similarly, when the second wear indicator 212*b* becomes exposed at the third wear level 210, a "Replace Tooth" indication may be triggered (at point 210*a*) as shown in FIGS. 11 and 12.

Thus, embodiments of the invention provide systems and methods for detecting heavy machine wear, such as detecting tooth wear. It should be understood that although embodiments are described herein in terms of detecting tooth wear, the methods and systems may be used to detect wear of any type of machine component. In addition, although embodiments are described herein in terms of a mining or excavating shovel, the methods and systems may be used with other types of heavy machines experiencing wear. Further, although embodiments are described herein in terms of a visual wear indicator or an electrical wear indicator, the methods and systems may be used with various configurations of wear indicators. For example, a wear indicator may function as both a visual wear indicator and an electrical wear indicator, a heavy machine tooth may include multiple wear indicators, or a combination thereof.

Various features and advantages of the invention are set forth in the following claims.

What is claimed is:

1. A system comprising:

a heavy machine tooth of an industrial machine having a working end and a mounting end opposite the working end, the working end interacting with a working material and the mounting end removably coupling the heavy machine tooth to the industrial machine;

a wear indicator included in the heavy machine tooth, the wear indicator including a conductive tip, a conductive outer body extending along at least a length of the heavy machine tooth defined between the working end and the mounting end, a conductive inner core positioned within the conductive outer body, and insulating material positioned between the conductive outer body and the conductive inner core, the conductive tip positioned between the working end of the heavy machine tooth and the conductive outer body and electrically coupling the conductive outer body and the conductive inner core to form an electric circuit; and a transmitter included in the heavy machine tooth, the transmitter transmitting a state of the electric circuit.

2. The system of claim 1, further comprising a receiver including an electronic processor, the electronic processor configured to receive the state of the electric circuit, determine a wear level of the heavy machine tooth based on the detected state of the electric circuit, and automatically perform an action based on the determined wear level of the heavy machine tooth.

3. The system of claim 2, wherein the action includes at least one selected from a group consisting of generating an alert, controlling operation of the industrial machine, generating and transmitting a communication, and logging data.

4. The system of claim 1, wherein the conductive inner core includes cylindrically-shaped conductive material, the conductive outer body includes ring-shaped conductive material, and the insulating material includes ring-shaped insulating material.

5. The system of claim 1, further comprising second insulating material provided over at least a portion of an external surface of the wear indicator.

6. The system of claim 1, further comprising a battery included in the heavy machine tooth, the battery supplying electric circuit to the transmitter.

7. The system of claim 1, wherein the transmitter includes a passive radio frequency identification (RFID) transponder receiving induced power from a RFID reader.

8. The system of claim 1, wherein the transmitter receives electric current through the electric circuit and transmits the detected state of the electric circuit by transmitting a signal when electric current is received through the electric circuit.

9. The system of claim 1, further comprising a sensor for detecting the state of the electric circuit.

10. The system of claim 9, wherein the sensor includes a current sensor detecting electric current through the electric circuit and wherein the transmitter transmits the detected state of the electric circuit by transmitting the detected electric current through the electric circuit.

11. The system of claim 1, wherein the conductive outer body of the wear indicator is constructed from at least two visually distinct materials to provide a visual indication of a wear level of the heavy machine tooth based on which of the at least two visually distinct materials is exposed.

12. A system comprising:

a heavy machine tooth of an industrial machine having a working end and a mounting end opposite the working end, the working end interacting with a working material and the mounting end removably coupling the heavy machine tooth to the industrial machine;

a first wear indicator included in the heavy machine tooth, the first wear indicator including a first conductive tip, a first conductive outer body, a first conductive inner core positioned within the first conductive outer body, and first insulating material positioned between the first conductive outer body and the first conductive inner core, the first conductive tip positioned between the working end and the first conductive outer body at a first distance from the working end, the first conductive tip electrically couples the first conductive outer body and the first conductive inner core to form a first electric circuit;

a second wear indicator included in the heavy machine tooth, the second wear indicator including a second conductive tip, a second conductive outer body, a second conductive inner core positioned within the second conductive outer body, and second insulating material positioned between the second conductive outer body and the second conductive inner core, the second conductive tip positioned between the working end and the second conductive outer body at a second distance from the working end different than the first distance, the second conductive tip electrically couples the second conductive outer body and the second conductive inner core to form a second electric circuit; and at least one transmitter included in the heavy machine tooth, the at least one transmitter transmitting at least one of a state of the first electric circuit and a state of the second electric circuit.

13. The system of claim 12, further comprising a receiver including an electronic processor, the electronic processor configured to receive the state of the first electric circuit and the state of the second electric circuit, determine a wear level of the heavy machine tooth based on the detected state of the first electric circuit and the detected state of the second electric circuit, and automatically perform an action based on the determined wear level of the heavy machine tooth.

14. The system of claim 12, wherein the first conductive inner core includes cylindrically-shaped conductive material, the first conductive outer body includes ring-shaped conductive material, and the first insulating material includes ring-shaped insulating material.

15. The system of claim 12, further comprising third insulating material provided over at least a portion of an external surface of the first wear indicator.

16. The system of claim 12, wherein the first conductive outer body includes material forming a portion of the heavy machine tooth.

17. The system of claim 12, wherein the at least one transmitter includes a passive radio frequency identification (RFID) transponder receiving induced power from a RFID reader.

18. A system comprising:

a heavy machine tooth of an industrial machine having a working end and a mounting end opposite the working end, the working end interacting with a working material and the mounting end removably coupling the heavy machine tooth to the industrial machine;

a wear indicator included in the heavy machine tooth, the wear indicator including a first conductive body, a second conductive body, and a plurality of conductive walls electrically coupling the first conductive body and the second conductive body to form an electric circuit;

a sensor detecting a resistance of the electric circuit, the resistance of the electric circuit varying based on a number of the plurality of conductive walls destroyed as the heavy machine tooth wears; and a transmitter included in the heavy machine tooth, the transmitter transmitting the detected resistance of the electric circuit.

19. The system of claim 18, wherein the first conductive body is positioned approximately parallel to the second conductive body along a length of the heavy machine tooth defined between the working end and the mounting end.

20. The system of claim 18, wherein each of the plurality of conductive walls has a different resistive value.

* * * * *